US009243488B2

(12) United States Patent
Pate

(10) Patent No.: US 9,243,488 B2
(45) Date of Patent: Jan. 26, 2016

(54) SENSOR MOUNTING ASSEMBLY FOR DRILL COLLAR STABILIZER

(71) Applicant: Precision Energy Services, Inc., Fort Worth, TX (US)

(72) Inventor: Lance C. Pate, Spring, TX (US)

(73) Assignee: PRECISION ENERGY SERVICES, INC., Fort Worth, TX (US)

( * ) Notice: Subject to any disclaimer, the term of this patent is extended or adjusted under 35 U.S.C. 154(b) by 555 days.

(21) Appl. No.: 13/651,864

(22) Filed: Oct. 15, 2012

(65) Prior Publication Data

US 2013/0105222 A1 May 2, 2013

Related U.S. Application Data

(60) Provisional application No. 61/551,609, filed on Oct. 26, 2011.

(51) Int. Cl.

| | |
|---|---|
| ***E21B 47/12*** | (2012.01) |
| ***E21B 47/01*** | (2012.01) |
| ***E21B 17/10*** | (2006.01) |

(52) U.S. Cl.

CPC ..... *E21B 47/01* (2013.01); *E21B 17/1014* (2013.01)

(58) Field of Classification Search

CPC ... E21B 47/01; E21B 17/1078; E21B 47/082; E21B 47/00

USPC ..... 175/50, 40, 45, 76, 325.1, 325.3; 166/254.2

See application file for complete search history.

(56) References Cited

U.S. PATENT DOCUMENTS

| | | | | | |
|---|---|---|---|---|---|
| 5,168,941 | A | * | 12/1992 | Krueger et al. | 175/26 |
| 5,200,705 | A | * | 4/1993 | Clark et al. | 324/338 |
| 5,235,285 | A | * | 8/1993 | Clark et al. | 324/342 |
| 5,250,806 | A | * | 10/1993 | Rhein-Knudsen et al. | 250/254 |
| 5,317,111 | A | * | 5/1994 | Orban et al. | 181/105 |
| 5,332,048 | A | * | 7/1994 | Underwood et al. | 175/26 |
| 5,339,037 | A | * | 8/1994 | Bonner et al. | 324/366 |
| 5,397,893 | A | * | 3/1995 | Minette | 250/254 |
| 5,451,779 | A | * | 9/1995 | Spross et al. | 250/266 |
| 5,631,563 | A | | 5/1997 | Moriarty | |
| 6,032,748 | A | * | 3/2000 | DeBray et al. | 175/325.7 |
| 6,173,793 | B1 | | 1/2001 | Thompson et al. | |
| 6,564,883 | B2 | | 5/2003 | Fredericks et al. | |
| 6,581,455 | B1 | * | 6/2003 | Berger et al. | 73/152.55 |

(Continued)

OTHER PUBLICATIONS

Office Action received in corresponding Canadian application No. 2,792,908, dated Oct. 22, 2013.

*Primary Examiner* — Daniel P Stephenson

(74) *Attorney, Agent, or Firm* — Blank Rome LLP

(57) ABSTRACT

A drill collar assembly allows a sensor to be mounted with the same standoff from a borehole wall independent of the size of stabilizer and borehole involved. A sensor component disposes in a receptacle in the drill collar, but does not affix in the receptacle. Instead, a stabilizer fits on the drill collar and covers the receptacle, and the sensor component mounts directly to the underside of the stabilizer so the component "floats" or "suspends" in the receptacle. The sensor component can mount at a stabilizer blade so the sensor can be positioned in closer proximity to the borehole wall to measure parameters of interest. Because the drill collar and sensor component can be used in different sized boreholes, different sized stabilizers may be positioned on the drill collar to account for the different sized boreholes while the sensor still has the same standoff.

50 Claims, 6 Drawing Sheets

(56) References Cited

U.S. PATENT DOCUMENTS

| | | | | |
|---|---|---|---|---|
| 6,600,321 | B2 | 7/2003 | Evans | |
| 6,622,803 | B2 | 9/2003 | Harvey et al. | |
| 6,655,452 | B2 * | 12/2003 | Zillinger | 166/66 |
| 6,666,285 | B2 | 12/2003 | Jones et al. | |
| 6,942,043 | B2 * | 9/2005 | Kurkoski | 175/40 |
| 7,250,768 | B2 | 7/2007 | Ritter et al. | |
| 7,284,605 | B2 * | 10/2007 | Clark et al. | 166/254.2 |
| 7,576,543 | B2 | 8/2009 | Ritter et al. | |
| 7,913,806 | B2 * | 3/2011 | Pabon et al. | 181/104 |
| 8,373,412 | B2 * | 2/2013 | Kruspe et al. | 324/303 |
| 8,866,483 | B2 * | 10/2014 | Bittar et al. | 324/374 |
| 8,957,683 | B2 * | 2/2015 | Bittar et al. | 324/339 |
| 2003/0155121 | A1 * | 8/2003 | Jones et al. | 166/254.2 |
| 2004/0237640 | A1 * | 12/2004 | Meister et al. | 73/152.48 |
| 2006/0220649 | A1 * | 10/2006 | Martinez et al. | 324/347 |
| 2006/0254767 | A1 * | 11/2006 | Pabon et al. | 166/254.2 |
| 2009/0025982 | A1 | 1/2009 | Hall et al. | |
| 2010/0147590 | A1 | 6/2010 | Morely et al. | |
| 2012/0031669 | A1 * | 2/2012 | Foster | 175/45 |

* cited by examiner

SENSOR MOUNTING ASSEMBLY FOR DRILL COLLAR STABILIZER

CROSS-REFERENCE TO RELATED APPLICATIONS

This application claims the benefit of U.S. Provisional Appl. No. 61/551,609, filed 26 Oct. 2011, which is incorporated herein by reference in its entirety.

BACKGROUND

FIG. 1 shows the general configuration of a drilling system in a Measurement-While-Drilling (MWD) or Logging-While-Drilling (LWD) environment. A downhole tool 10 disposes in a borehole BH and is operationally connected to a drill string 12 by a suitable connector 14. At its lower end, the tool 10 has a drill bit 16. Uphole, a rotary drilling rig 60 rotates the drill string 12, the downhole tool 10, and the drill bit 16 to drill the borehole BH. As will be appreciated, other types of borehole conveyance can be used for the downhole tool 10.

The downhole tool 10 has a drill collar 20, a borehole sensor 50, and an electronics subsection 52. The drill collar 20 has a stabilizer sleeve 30 disposed thereon, and the borehole sensor 50 is mounted at a stabilizer blade 32. Depending on the desired parameters of interest, the borehole sensor 50 measures data in the borehole environs, and the electronics subsection 52 can process and store the data and can telemeter the data uphole for any of the various purposes associated with LWD/MWD.

A surface processor 64 cooperating with the electronic subsection 52 may handle the data and can perform additional mathematical operations associated with standard geological applications. Processed data can then be output to a recorder 66 for storage and optionally for output as a function of measured depth thereby forming an "image" or "log" 68 of one or more parameters of interest. All throughout operations, signals can be sent downhole to vary the direction of drilling or to vary the operation of the downhole tool 10.

There are a few techniques for mounting a sensor on a downhole tool 10 for interaction with a borehole BH. Conventional wisdom in the art has been to either install the sensor externally on a drill collar or stabilizer or to particularly configure the sensor to install on the drill collar or stabilizer. Thus, one technique simply mounts a sensor with a plate on a portion of a drill collar. For example, U.S. Pat. No. 7,250,768 to Ritter et al. discloses a modular cross-over sub for a bottom hole drilling assembly having a stabilizer. Separate from the stabilizer, a resistivity sensor on a plate affixes to the outside of the sub where the sensor and measuring electronics are disposed.

Alternatively, a sensor can be directly part of a stabilizer. For example, U.S. Pat. Pub. No. 2009/0025982 discloses instrumentation devices disposed externally on a blade of a stabilizer using rings attached to the blade with screws or other attachment means.

Finally, a particularized package for a sensor can fit in a recess of a downhole tool and can have a stabilizer fit thereover. For example, U.S. Pat. No. 6,666,285 to Jones et al. discloses a drilling conduit having a cavity particularly sized to receive an instrument package. A portion of the package radially protrudes a distance, and an alignment channel in a stabilizer element is dimensioned to receive the protruding portion of the instrument package. For ease of manufacturing, the alignment channel extends the entire length of the stabilizer element.

As a particular example, FIG. 2 is a side cross-section of a portion of a downhole tool 10 having a sensor and stabilizer arrangement according to the prior art. The drill collar 20 is shown with its internal bore 22 for passage of drilling fluid. A sensor housing 40 fits inside a recess or pocket 24 formed on the outside surface 23 of the drill collar 20 and hard-mounts to the drill collar 20 using mounting components 42. The sensor housing 40 has a sensor 50 (e.g., LWD downhole measurement equipment), and the hard mounting of the housing 40 provides stable positioning of the sensor 50 and helps protect the sensor 50 from damage.

The sensors used for LWD/MWD applications typically measure parameters of the formation traversed by the borehole or of the borehole itself. In typical applications, measurement accuracy is degraded by excessive and/or inconsistent standoff between the sensor and the surrounding borehole wall. To reduce standoff, the sensor 50 may actually be positioned in the drill collar's pocket 24 at a further radial distance than the drill collar's outer surface 23. This allows the sensor 50 to position closer to the borehole wall. To help maintain the consistent standoff and to protect the sensor 50, a stabilizer sleeve 30 is typically employed and is positioned directly on the drill collar's outer surface 23. When the sleeve 30 is pushed into position on the outside of the drill collar 20, one of the stabilizer blades 32 on the stabilizer sleeve 30 fits directly over the sensor housing 40, and the stabilizer sleeve 30 can be retained using a shoulder on the drill collar 20 and a bushing 34 or other features.

Because the housing 40 is physically mounted to the collar 20, the distance between the sensor 50 and the borehole wall will change if the diameter of the borehole BH to be drilled is changed and if the stabilizer sleeve's diameter is also changed accordingly. This impacts the ability to make consistent measurements with the sensor 50 when used in different configurations because the changes in distance from the borehole wall will attenuate the measurements made.

For example, FIGS. 3A-3B are end views diagramming the prior art sensor and stabilizer arrangement for different sized boreholes $BH_1$ and $BH_2$. As can be seen, the radius $R_1$ of the first borehole $BH_1$ is smaller than the radius $R_2$ of the second borehole $BH_2$. As is common, the same sized drill collar 20 may be used to drill both of these boreholes $BH_1$ and $BH_2$, while other components of the drilling system are changed to create the different sized boreholes $BH_1$ and $BH_2$. To account for the difference in borehole size relative to the same sized drill collar 20, different sized stabilizer sleeves $\mathbf{30}_1$ and $\mathbf{30}_2$ are used when drilling. For instance, the first stabilizer sleeve $\mathbf{30}_1$ for the smaller borehole $BH_1$ has lower profile stabilizer blades $\mathbf{32}_1$, while the other stabilizer sleeve $\mathbf{30}_2$ for the larger borehole $BH_2$ has higher profile stabilizer blades $\mathbf{32}_2$.

Yet, in both circumstances, the sensor housing 40 hard-mounted to the drill collar 20 keeps the sensor 50 at the same position on the drill collar 20. As a result, the sensor 50 has a smaller standoff $S_1$ relative to the wall of the smaller borehole $BH_1$, but has a larger standoff $S_2$ relative to the wall of the larger borehole $BH_2$.

For measurement accuracy, the sensor 50 is typically calibrated electronically and with processing algorithms to operate best with a particular standoff from the borehole wall. Due to the different sized stabilizer sleeves $\mathbf{30}_1$ and $\mathbf{30}_2$ needed in some drilling applications as seen in FIGS. 3A-3B, the standoff under which the sensor 50 measures can change. To obtain useful measurements, operators must therefore recalibrate the sensor 50 to operate with the different standoffs $S_1$ and $S_2$, or an entirely different sensor housing 40 may need to be used so the sensor 50 will have the calibrated standoff.

As always, changes or modifications made in drilling applications can increase costs, slow down drilling operations, engender unwanted errors, and the like. For these and other reasons, the subject matter of the present disclosure is directed to overcoming, or at least reducing the effects of, one or more of the problems set forth above.

SUMMARY

A sensor and stabilizer arrangement for a borehole drilling tool allows a sensor to be mounted with the same standoff from a borehole wall independent of the size of stabilizer, borehole, and collar involved. The drilling tool has a drilling body, such as a drill collar, defining a receptacle exposed in its outer surface. An electronic sensor component for an LWD/MWD-type sensor or detector disposes in the receptacle, but does not affix in the receptacle. Instead, a stabilizer fits over the drill collar and covers the receptacle and sensor component, and the sensor component mounts directly to the underside of the stabilizer. For example, fasteners affix in openings on the outside surface of the stabilizer and mount the sensor component directly to the underside of the stabilizer so that the electronic component "floats" or "suspends" in the receptacle. Preferably, the sensor component mounts directly to the stabilizer's underside at one of the stabilizer blades so a sensor element exposed on the outside of the stabilizer can be positioned in proximity to the borehole wall to measure parameters of interest.

The drill collar and sensor component can be used in different sized boreholes during drilling, and different sized stabilizer may be positioned on the drill collar to account for the different sized boreholes. Thus, the disclosed arrangement offers a modular system in which the same sensor component and drill collar can be used together and different sized stabilizers can be interchanged thereon depending on the borehole size. Because the same sized drill collar and sensor components may be used to drill larger or smaller sized boreholes, having the sensor component mounted directly underneath the stabilizer maintains the same standoff between the sensor and the borehole wall regardless of the borehole size being drilled. Thus, operators can use the same sensor components for different sized boreholes and do not need to reconfigure or recalibrate the sensor to operate with a different standoff in different sized boreholes.

The disclosed stabilizer and sensor arrangement is in contrast to the typical hard-mounting of sensor components to the drill collar in the prior art. Being coupled to the stabilizer, the sensor maintains a consistent standoff from the borehole wall, and the sensor can be calibrated to obtain the best measurements with this particular standoff. The disclosed arrangement can offer a number of benefits in the operation of a drilling tool having a sensor because the arrangement maintains a consistent distance between the borehole wall and any sensors, independent of tool body size, stabilizer size, or borehole size. As a result, there will be less measurement attenuation in comparison to the current collar mounted scheme.

The foregoing summary is not intended to summarize each potential embodiment or every aspect of the present disclosure.

BRIEF DESCRIPTION OF THE DRAWINGS

FIG. 6B-1 is a plan view of a sensor housing for the disclosed sensor and stabilizer arrangement.

FIG. 6B-2 is an end view of the sensor housing of FIG. 6B-1.

DETAILED DESCRIPTION

Figure 4:
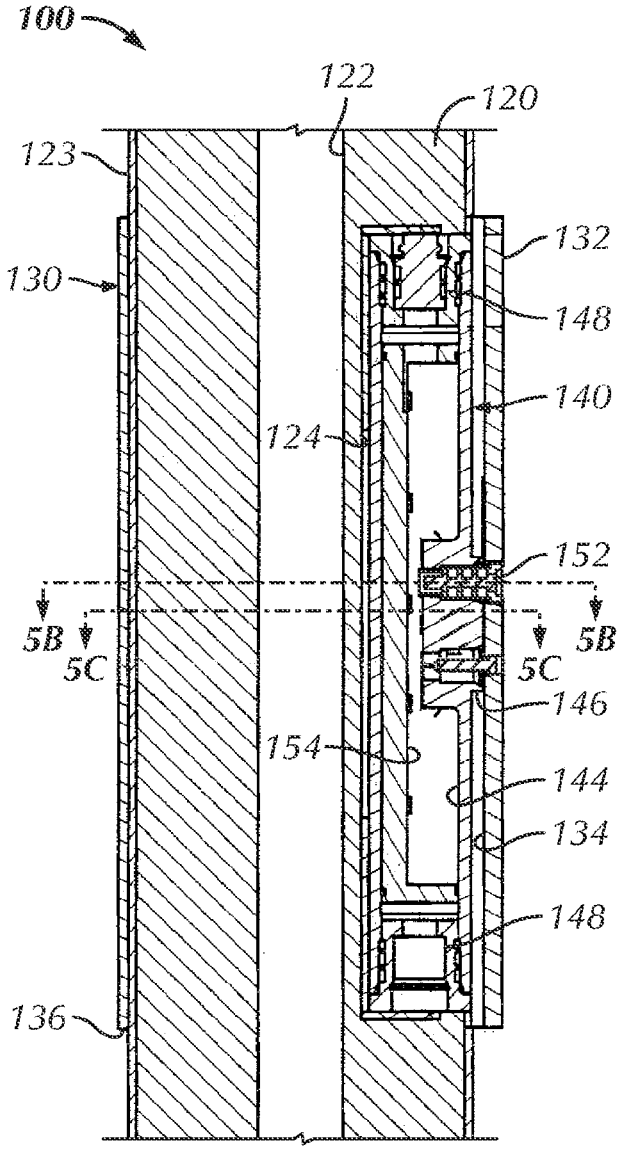
FIG. 4 is a side cross-section showing a downhole tool having a sensor and stabilizer arrangement according to the present disclosure.

FIG. 4 is a side cross-section showing a downhole tool 100 having a sensor and stabilizer arrangement according to the present disclosure. The tool 100 can be used on a drilling assembly, such as discussed previously in FIG. 1. The tool 100 includes a downhole tubular 120, such as a drill collar or other drilling body. The drill collar 120 carries a sensor component, which includes a sensor housing 140 and sensor 150 for MWD/LWD applications in a borehole. As is customary, the drill collar 120 can have an internal bore 122 for passage of drilling fluid and can have an outside surface 123 with a protective sheathing.

The tool's sensor housing 140 disposes in a receptacle or pocket 124 formed on the outer surface 123 of the drill collar 120. The sensor housing 140 holds the borehole sensor 150 beyond the collar's outer surface 123 so the sensor 150 can be positioned in closer proximity to a borehole wall (not shown) for measuring parameters of interest. As will be appreciated, the sensor 150 can be any LWD/MWD sensor, detector, or other device used in the art, including, but not limited to, a resistivity imager, a gamma sensor, an extendable formation testing sensor, a transducer, a transceiver, a receiver, a transmitter, acoustic element, etc. To provide strength and to reduce electrical interference, the sensor housing 140 can be made from a suitable alloy.

The drill collar 120 has a stabilizer 130 disposed thereon to stabilize the drill collar 120 during operation and to position the sensor 150 closer to the borehole wall. Although not shown, the stabilizer 130 can affix to the drill collar 120 using any of the common techniques known in the art. For example, the stabilizer 130 can be heat shrunk onto the collar 120, and/or ends 136 of the stabilizer 130 can be affixed by welding, fasteners, or the like.

Rather than hard-mounting the sensor housing 140 to the drill collar 120 as in the prior art, the sensor housing 140 mounts directly to the underside or undersurface 134 of the stabilizer 130 and preferably mounts at one of the extended stabilizer blades 132. By mounting directly to the undersurface 134, the sensor housing 140 is essentially supported at its circumferential distance on the drill collar 120 independent of the receptacle 124. Accordingly, the housing 140 "floats" or "suspends" in the drill collar's receptacle 124. As shown in FIG. 4, for example, the sensor housing 140 is shown disposed in, but not mounted in, the sensor receptacle 124 of the drill collar 120. A top surface 146 of the sensor housing 140 mounts directly to the undersurface 134 of the stabilizer 130 so that sensor openings in the housing 140 align with corresponding openings in the stabilizer 130. If desired, support (i.e., shims, spacers, shock absorbers, etc.) can be used in the space between the sensor housing 140 and the receptacle 124.

The sensor housing 140 has a central passage or compartment 144 in which electronic components 154 of the sensor 150 mount. Typically, the electronic components 154 include a circuit board, power supply, and other elements needed for operation of the sensor 150. The internal components 154 can operatively couple to one or more external sensor elements 152 exposed on the surface of the stabilizer 150, but this depends on the sensor 150 used as some sensors may not require such an exposed element 152. The sensor element 152 is intended to interact with the borehole wall, annulus, etc. to obtain measurements of interest.

End caps 148 affix to open ends of the housing 140 to seal the housing's compartment 144 so the electronic components 154 can be protected from pressures and drilling fluid. These end caps 148 can have passages to communicate electric wiring, hydraulics, or the like between the sensor components 154 and other parts of the tool 100, such as memory or telemetry components.

Figure 5A:
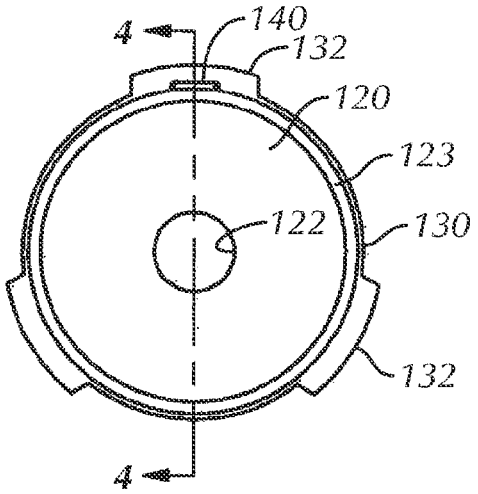
FIG. 5A is an end view of the downhole tool of FIG. 4.
Figure 5B:
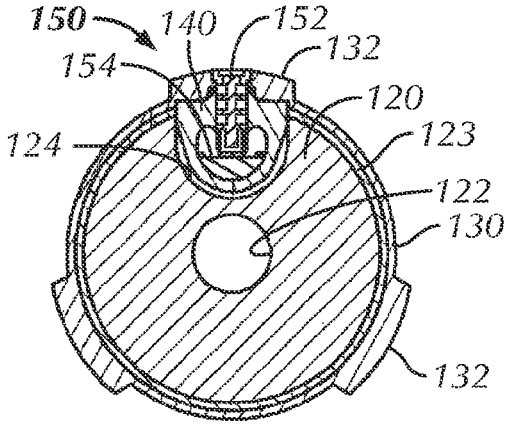
FIGS. 5B-5C are end-sections of the downhole tool of FIG. 4.

FIG. 5A is an end view of the drill collar 120, showing the arrangement of the stabilizer 130 and blades 132 about the collar's outer surface 123. The end-section of FIG. 5B shows the sensor housing 140 disposed in the collar's receptacle 124 and abutted against the undersurface 134 of the stabilizer 130 at one of the blades 132. The sensor element 152 is shown exposed on the surface of the blade 132 and extending into the housing's compartment 144 where the sensor element 152 operatively couples to the electronic components 154.

Figure 5C:
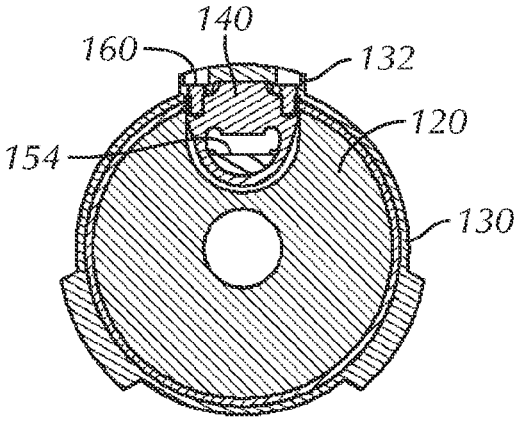

Finally, the end-section of FIG. 5C shows the sensor housing 140 mounted directly to (i.e., directly attached or affixed to) the collar's undersurface 134 using fasteners 160. Although one of the blades 132 has a sensor housing 140 and sensor 150 as detailed herein, one or more of the other blades 132 could also have such components. Moreover, although preferred, the sensor component (i.e., housing 140 and sensor 150) need not be disposed at a blade, if any, on the stabilizer 130.

Figure 6A:
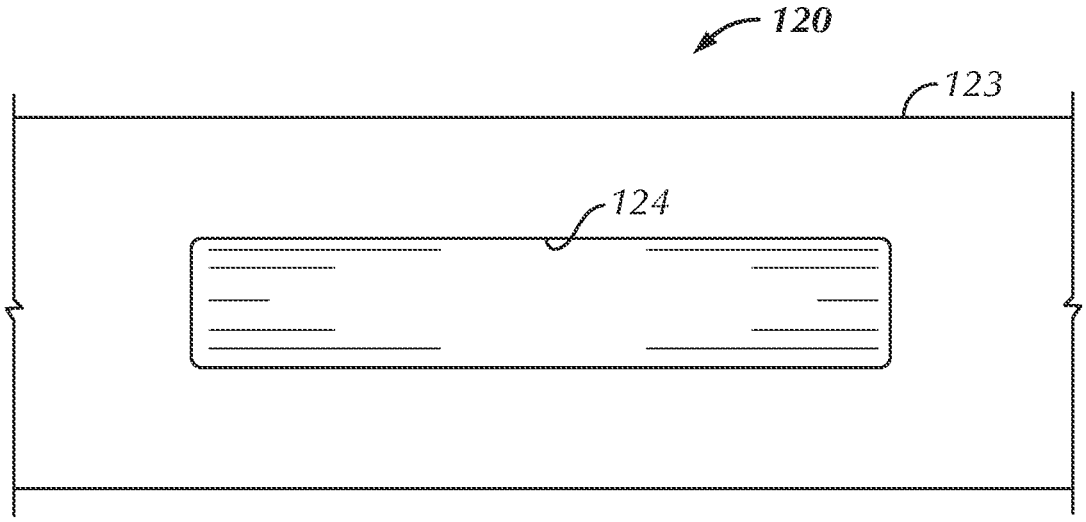
FIG. 6A is a plan view of a drill collar for the disclosed sensor and stabilizer arrangement.

With a general understanding of the stabilizer and sensor arrangement, assembly of the disclosed arrangement is discussed with reference to FIGS. 6A through 6C. As shown in the plan view of FIG. 6A, the drill collar 120 has its receptacle 124 formed in its outer surface 123 using conventional techniques. Various channels or passages (not shown) may be defined in the collar 120 to communicate electronic wiring, hydraulics, and the like to any components to be held in the receptacle 124. As noted herein, the sensor housing 140 does not mount to the drill collar 120 so fastening holes may not be present, although various alignment holes (not shown) may be provided in the receptacle's bottom surface to receive alignment pins or the like so the housing 140 can be aligned in the receptacle 124.

Figure 1:
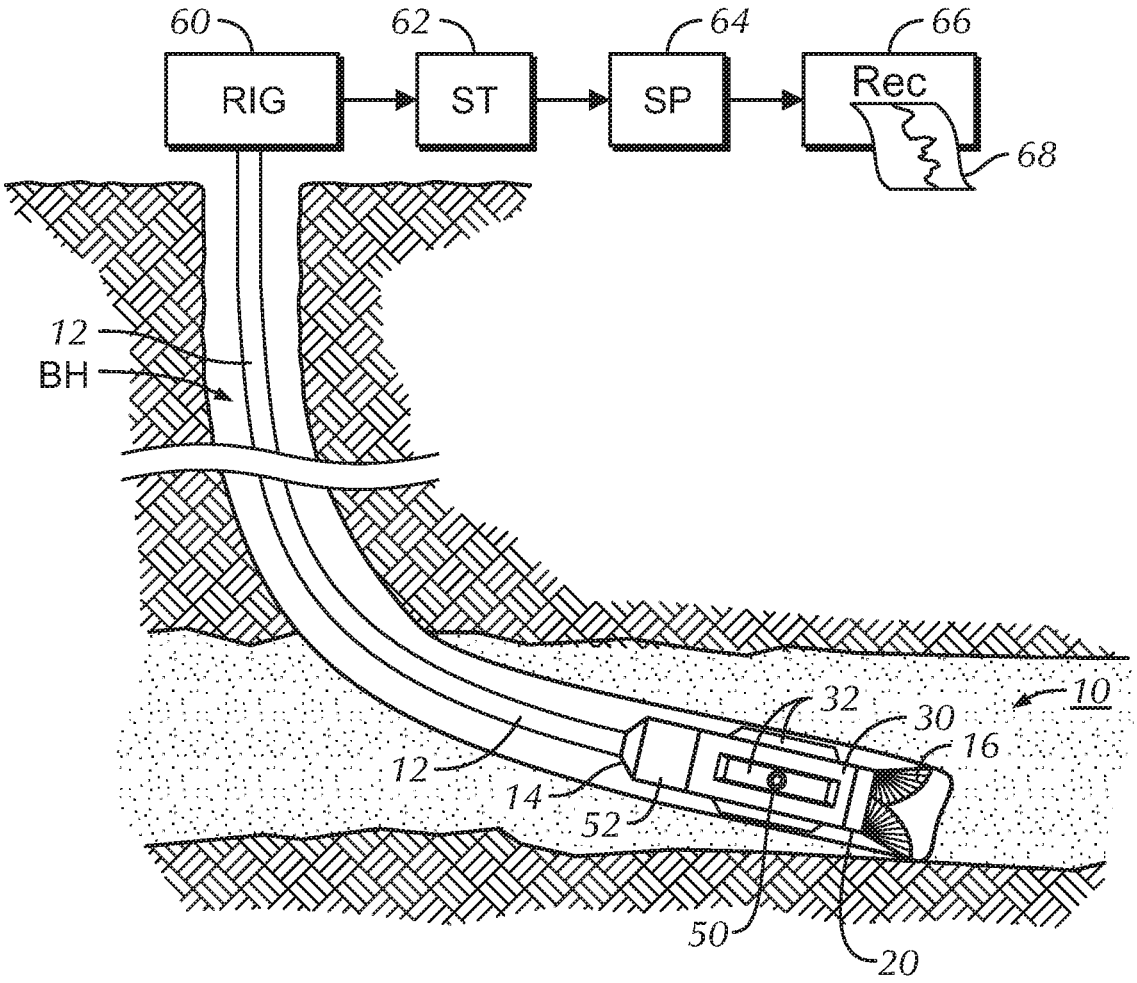
FIG. 1 (Prior Art)
FIG. 1 illustrates a drilling assembly having a sensor mounted on a stabilizer of a downhole tool.
Figure 2:
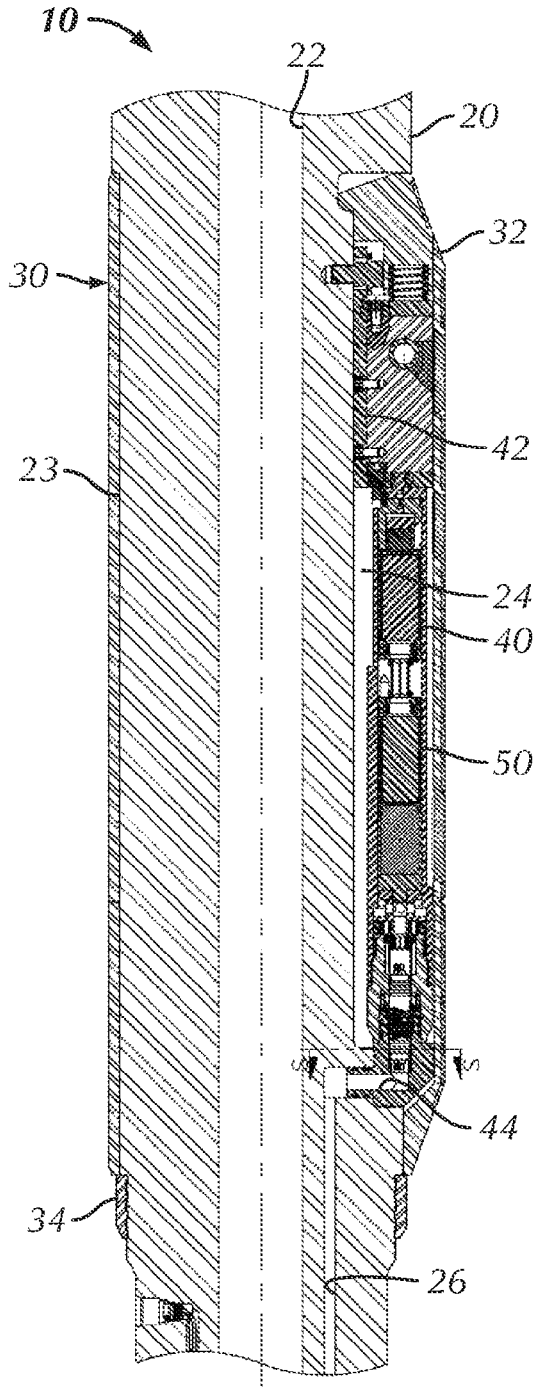
FIG. 2 (Prior Art)
FIG. 2 is a side cross-section of a downhole tool having a sensor and stabilizer arrangement according to the prior art.
Figure 3A:
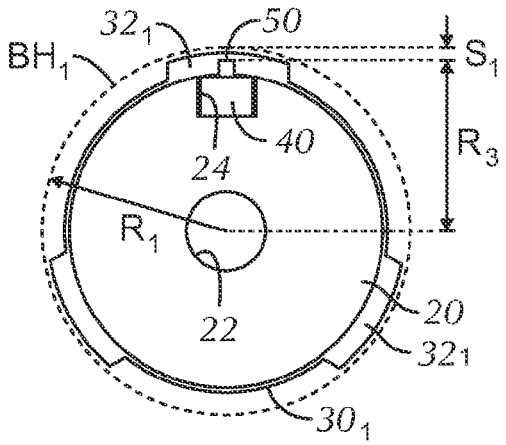
FIG. 3A (Prior Art)
FIGS. 3A-3B are end views showing the prior art sensor and stabilizer arrangement for different sized boreholes.
Figure 3B:
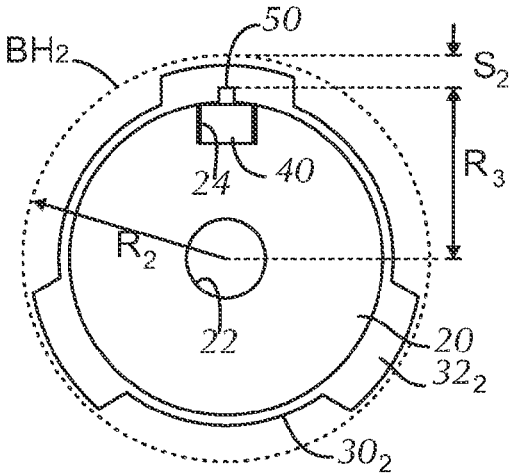
FIG. 3B (Prior Art)
Figures 1, 6B:
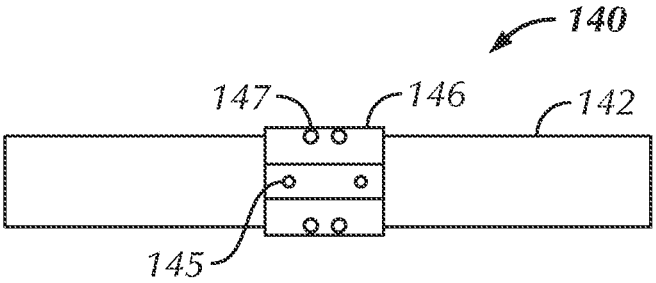
Figures 2, 6B:
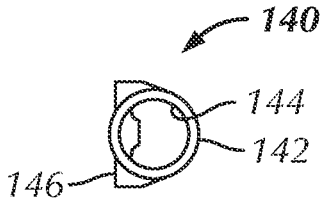

The sensor housing 140 is a pressure housing, and as shown in FIGS. 6B-1 and 6B-2, the housing 140 can have an elongated, cylindrical body 142, although other shapes such as rectilinear shapes can be used. The body 142 defines the internal compartment 144 for electronics and has one or more mounting surfaces or platforms 146 with fastener holes 147, alignment pin holes, and sensor holes 145 for aligning with holes in the stabilizer 130 as discussed below. Although alignment can be achieved in a number of ways between the components, alignment for the housing 140 is preferably accomplished using pins (not shown) between the sensor housing 140 and the stabilizer 130.

Figure 6C:
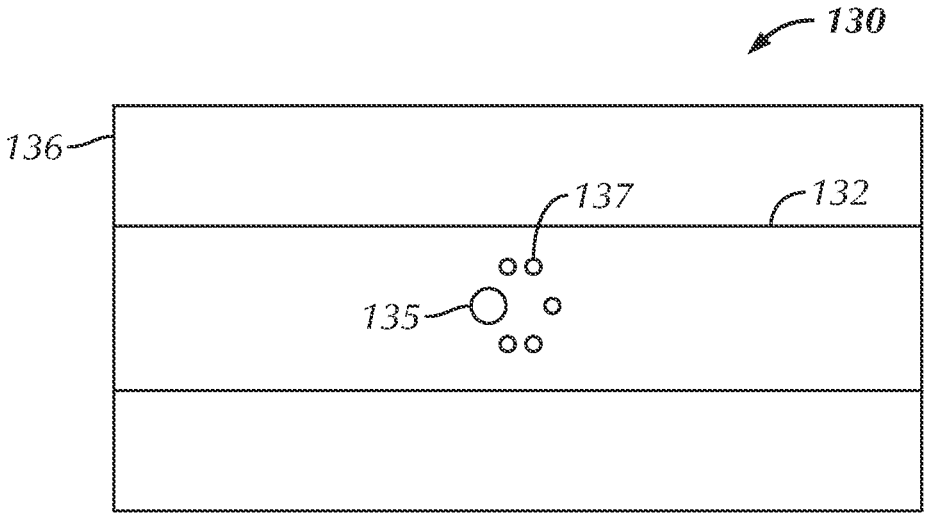
FIG. 6C is a plan view of a stabilizer for the disclosed sensor and stabilizer arrangement.

As shown in FIG. 6C and elsewhere, the stabilizer 130 is typically a cylindrical sleeve and has a number of outward extending blades 132, ribs, arms, or other features that increase the outer dimension of the stabilizer 130. The stabilizer 130 fits over the drill collar 120 and mounts thereon using techniques known in the art, such as heat shrinking, welding, bolting, and the like. The stabilizer 130 has a number of holes or openings defined in one of the blades 132 or elsewhere, including sensor openings 135 for portions of the sensor 150 to face the borehole environs. Other openings 137 are mounting pin holes to receive mounting bolts or fasteners (160) to hold the sensor housing 140 underneath the stabilizer 130, as discussed previously.

During assembly, the sensor housing 140 is outfitted with the components and electronics of the sensor 150, end caps 148, etc. Assemblers then set the housing 140 temporarily in the collar's receptacle 124. Assemblers then slide the stabilizer 130 shown in FIG. 6C over the drill collar's outer surface 123 while the sensor housing 140 rests in the receptacle 124. When properly positioned, assemblers then position fasteners 160 through openings 137 in the stabilizer 130 to affix to the fastener holes 147 on the housing's mounting surface 146. As the fasteners are tightened, the sensor housing 140 "floats" or "suspends" in the collar's receptacle 124 and mounts directly to the underside of the stabilizer 130. The sensor element 152 can then be installed as needed into the sensor openings 135 in the stabilizer 130 to connect with the electronic components 154 installed in the housing 140 underneath.

Figure 7A:
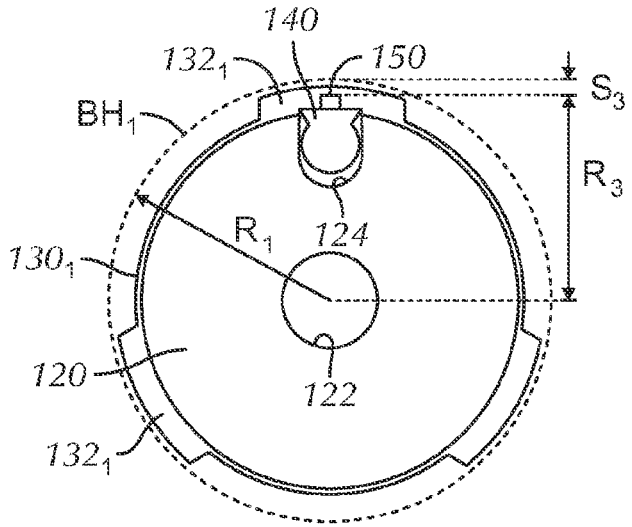
FIGS. 7A-7B are end views diagramming the disclosed sensor and stabilizer arrangement for different sized boreholes.
Figure 7B:
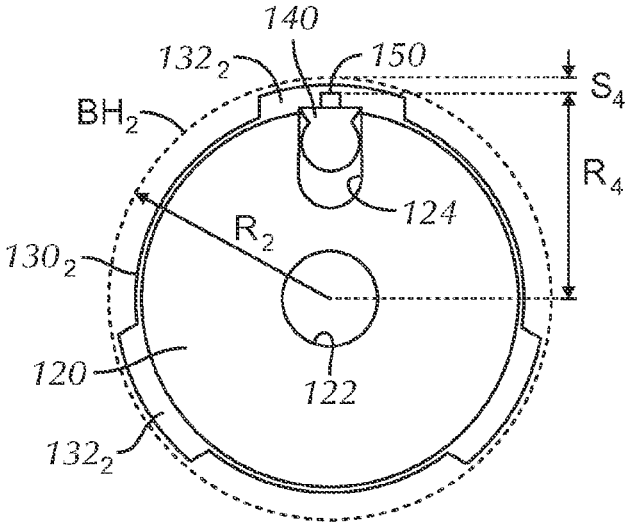

The advantages of the sensor and stabilizer arrangement of the present disclosure are best illustrated with reference to FIGS. 7A-7B, which show the disclosed sensor and stabilizer arrangement for different sized boreholes. As can be seen, the radius $R_1$ of a first borehole $BH_1$ (FIG. 7A) is smaller than the radius $R_2$ of a second borehole $BH_2$ (FIG. 7B). Again, the same sized drill collar 120 may be used in some circumstances to drill both of these boreholes $BH_1$ and $BH_2$ because other components of the drilling assembly may be changed to create the different sized boreholes $BH_1$ and $BH_2$.

To account for the difference in borehole size relative to the same sized drill collar 120, different sized stabilizers $\mathbf{130}_1$ and $\mathbf{130}_2$ are used when drilling. The first stabilizer $\mathbf{130}_1$ (FIG. 7A) for the smaller borehole $BH_1$ has lower profile stabilizer blades $\mathbf{132}_1$, while the other stabilizer $\mathbf{130}_2$ (FIG. 7B) for the larger borehole $BH_2$ has higher profile stabilizer blades $\mathbf{132}_2$.

Yet, in both circumstances, the sensor housing 140 mounted to the undersurface 134 of the stabilizer 130 keeps the sensor 150 at similar standoffs $S_3$ and $S_4$ from the borehole wall. The similar standoffs $S_3$ and $S_4$ are preferably the same, although they may vary to some degree dependent on the sensitivity and calibration of the sensor 150. Having the similar standoffs $S_3$ and $S_4$ is possible because the sensor housing 140 "floats" or "suspends" in the collar's receptacle 124 as noted above and sits at different radii $R_3$ and $R_4$, respectively, for the different sized boreholes $BH_1$ and $BH_2$.

As noted previously, the sensor 150 is calibrated electronically with processing algorithms to operate best with a particular standoff from the borehole wall. Using the disclosed arrangement, the particular standoff S for the sensor 150 can be maintained despite the different sized stabilizers $\mathbf{130}_1$ and $\mathbf{130}_2$ needed in some drilling applications. Accordingly, operators do not need to recalibrate the sensor 150 to operate with a different standoff and do not need to use an entirely different sensor as required in the prior art. Thus, the disclosed arrangement offers a modular system in which the same component, including sensor 150 and housing 140, and the same drill collar 120 can be used together and in which different sized stabilizers $\mathbf{130}_1$ and $\mathbf{130}_2$ can be interchanged on the drill collar 120 depending on the borehole size.

Figure 8:
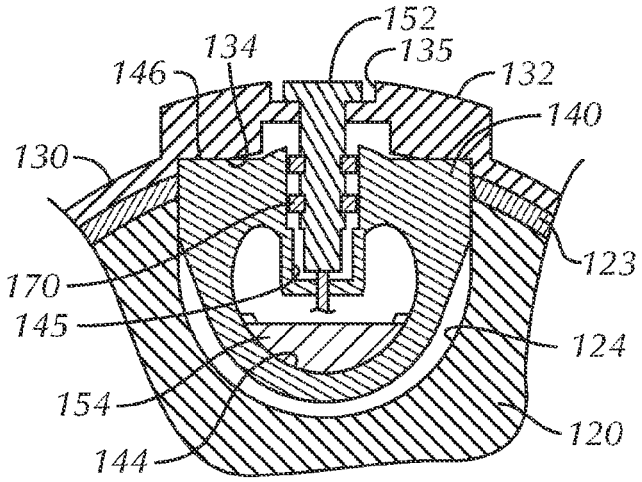
FIG. 8 is an end-section detailing the stabilizer, the sensor housing, and other components.

In addition to the above, there are other advantages of the disclosed sensor and stabilizer arrangement. FIG. 8 shows a detailed end-section of the sensor housing 140 mounted on the underside 134 of the stabilizer 130. As noted before, the sensor housing 140 is disposed in the collar's receptacle 124, and the housing's mounting surface 146 is abutted against the undersurface 134 of the stabilizer 130 at one of the blades 132.

The sensor element 152 is installed in the sensor opening 135 of the blade 132 and extends down into the sensor opening 145 in the sensor housing 140. Various features, such as fasteners, threads, bushings, welds, etc. are not shown, but can be used to retain the sensor component 150 in these openings 135 and 145. In addition to (or as an alternative to) such features, one or more sealing members 170 can be disposed between the interface of the sensor component 150 and the housing's opening 145. Thus, the sensor element 152 is exposed on the surface of the blade 132 and extends into the housing's sealed compartment 144 where the element 152 operatively couples to the electronic components 154.

Figure 9A:
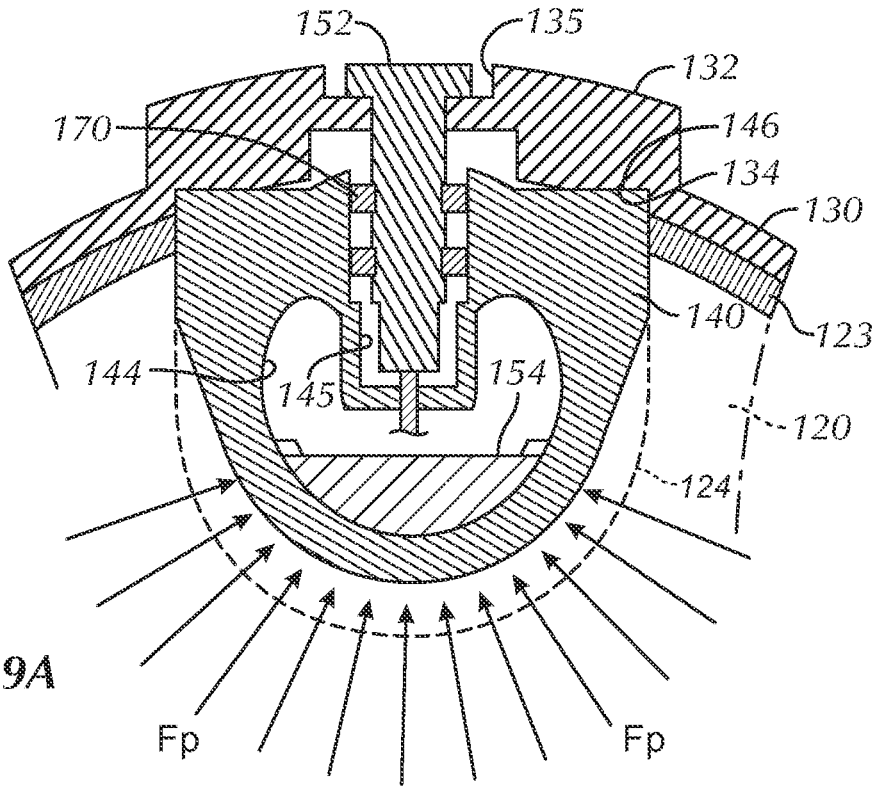
FIGS. 9A-9B are end-sections showing pressure forces acting on the sensor housing and sensor element.

When the drill collar 120 is deployed downhole in a borehole, fluid pressure $F_p$ from the borehole as shown in FIG. 9A may enter inside the drill collar's sensor receptacle 124, depending on the sealing used. In turn, the fluid pressure $F_p$ in the receptacle 124 acts against the surfaces of the housing 140, and the net force of this fluid pressure $F_p$ preferably forces the housing's mounting surface 146 against the undersurface 134 of the stabilizer 130. Overall, the force of this fluid pressure $F_p$ can help hold the sensor housing 140 in place on the stabilizer's undersurface 134.

Figure 9B:
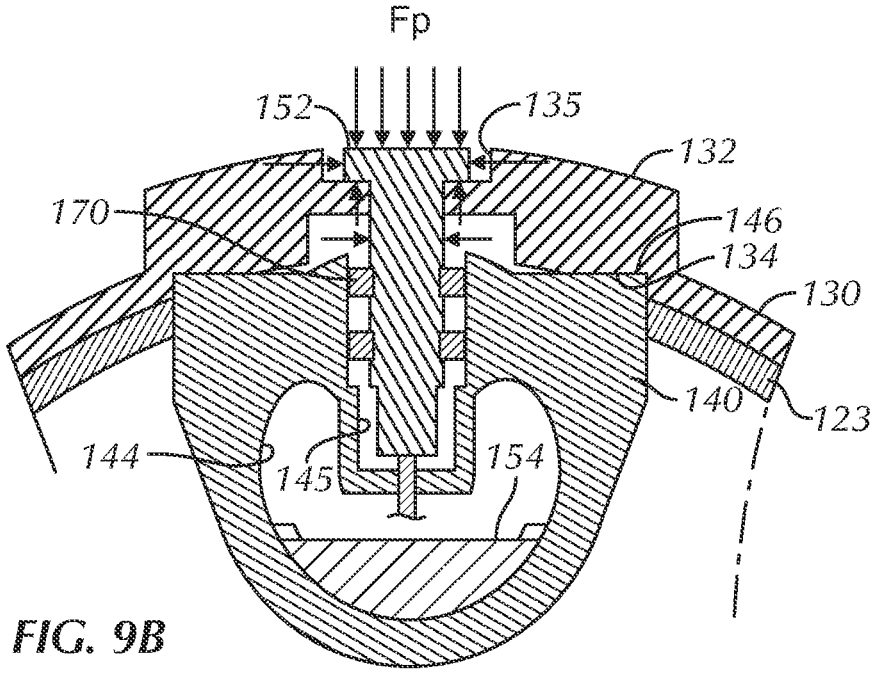

As shown in FIG. 9B, fluid pressure $F_p$ in the borehole annulus also acts against the surfaces of the sensor element 152 outside the sealing members 170 used. The net force of the fluid pressure $F_p$ preferably tends to hold the sensor element 152 in the stabilizer blade 132 and housing 140. As noted previously, the interior compartment 144 of the housing 140 is preferably fluidly isolated from the borehole so the electronic components 154 can be protected. The sealing members 170 used in the opening 145 help isolate the components 154 from fluid and help to keep the housing's interior compartment 144 at a lower pressure (e.g., atmospheric) than the borehole annulus. Advantageously, this difference in pressure between the upper and lower ends of the sensor element 152 tends to further retain the element 152 in the openings 135 and 145 of the blade 132 and housing 140.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A borehole drilling tool, comprising:

a drilling body having an outer surface and defining a receptacle exposed in the outer surface;

a first stabilizer having a first underside, the first stabilizer disposed on the outer surface of the drilling body and covering the receptacle; and a sensor component for measuring in the borehole, the sensor component disposed in the receptacle and mounted with a mounting surface thereof directly affixed to the first underside of the first stabilizer.

2. The tool of claim 1, wherein the drilling body comprises a drill collar for a drillstring.

3. The tool of claim 1, wherein the first stabilizer comprises a cylindrical sleeve fitting around the outer surface of the drilling body.

4. The tool of claim 1, wherein one or more fasteners dispose in openings in a topside of the first stabilizer and affix the sensor component to the first underside of the first stabilizer.

5. The tool of claim 1, wherein the receptacle is larger than the sensor component such that the sensor component suspends in the receptacle.

6. The tool of claim 1, wherein the first stabilizer comprises at least one blade extending outward therefrom, the sensor component being mounted directly to the first underside of the first stabilizer at the at least one blade.

7. The tool of claim 1, wherein the sensor component has a first standoff from a wall of a first sized borehole.

8. The tool of claim 7, further comprising a second stabilizer having a different size than the first stabilizer and having a second underside, the second stabilizer being interchangeably disposed on the outer surface of the drilling body instead of the first stabilizer and covering the receptacle, the sensor component mounting with the mounting surface thereof directly affixed to the second underside of the second stabilizer and having a second standoff from a wall of a second sized borehole.

9. The tool of claim 7, wherein the second sized borehole is larger or smaller than the first sized borehole, and wherein the second standoff is approximately equal to the first standoff.

10. The tool of claim 1, wherein the sensor component comprises a housing mounted directly to the first underside of the first stabilizer and housing electronics therein.

11. The tool of claim 10, wherein the housing comprises at least one end cap disposed thereon and enclosing the electronics housed therein.

12. The tool of claim 10, wherein the housing comprises:

the mounting surface disposed against the first underside; and a surrounding surface at least partially exposed in the receptacle, wherein fluid pressure of the borehole in the receptacle acts against the surrounding surface of the housing and forces the mounting surface against the first underside.

13. The tool of claim 1, wherein the sensor component comprises a sensor element exposed in an opening on a topside of the first stabilizer.

14. The tool of claim 13, wherein the sensor element comprises one or more seals sealing the sensor element in the sensor component and isolating a first fluid pressure of the borehole from a second fluid pressure in the sensor component.

15. The tool of claim 14, wherein a pressure differential between the first and second fluid pressures forces the sensor element into the sensor component.

16. A modular borehole drilling tool, comprising:

a drilling body having an outer surface and defining a receptacle exposed in the outer surface;

a sensor component disposing in the receptacle; and at least two stabilizers having different sizes for use in different sized boreholes, each of the at least two stabilizers interchangeably disposing on the outer surface of the drilling body and covering the receptacle;

wherein the sensor component mounts directly to an underside of either of the at least two stabilizers when disposed on the drilling body such that the sensor component suspends in the receptacle, and wherein the sensor component mounted directly to either of the at least two stabilizers has a same standoff distance to walls of the different sized boreholes when disposed relative thereto.

17. The tool of claim 16, wherein the drilling body comprises a drill collar for a drillstring.

18. The tool of claim 16, wherein the at least two stabilizers each comprises a cylindrical sleeve fitting around the outer surface of the drilling body.

19. The tool of claim 16, wherein one or more fasteners dispose in openings in a topside of the at least two stabilizers and affix the sensor component to the underside.

20. The tool of claim 16, wherein the receptacle is larger than the sensor component.

21. The tool of claim 16, wherein the at least two stabilizers each comprises at least one blade extending outward therefrom, the sensor component being mounted directly to the underside of the at least two stabilizers at the at least one blade.

22. The tool of claim 16, wherein the sensor component comprises a housing being mounted directly to the underside of the at least two stabilizers and housing electronics therein.

23. The tool of claim 22, wherein the housing comprises at least one end cap disposed thereon and enclosing the electronics housed therein.

24. The tool of claim 22, wherein the housing comprises:

a mounting surface disposed against the underside; and a surrounding surface at least partially exposed in the receptacle, wherein fluid pressure of the borehole in the receptacle acts against the surrounding surface of the housing and forces the mounting surface against the underside.

25. The tool of claim 16, wherein the sensor component comprises a sensor element exposed in an opening on a topside of the at least two stabilizers.

26. The tool of claim 25, wherein the sensor element comprises one or more seals sealing the sensor element in the sensor component and isolating a first fluid pressure of the borehole from a second fluid pressure in the sensor component.

27. The tool of claim 26, wherein a pressure differential between the first and second fluid pressures forces the sensor element into the sensor component.

28. A borehole drilling tool assembly method, comprising:

configuring a borehole sensor component for operation with a standoff from a wall of a borehole;

disposing the borehole sensor component in a receptacle defined in an outside surface of a drilling body;

selecting one of a plurality of stabilizers configured for a borehole size to be drilled with the drilling body, each of the stabilizers configured for a different sized borehole to be drilled with the drilling body;

disposing the selected stabilizer on the drilling body over the receptacle and the borehole sensor component; and mounting the borehole sensor component with a mounting surface thereof directly affixed to an underside of the selected stabilizer.

29. The method of claim 28, wherein the drilling body comprises a drill collar for a drillstring, and wherein disposing the selected stabilizer on the drilling body over the receptacle and the borehole sensor component comprises fitting a cylindrical sleeve of the selected stabilizer around the outside surface of the drill collar.

30. The method of claim 28, wherein mounting the borehole sensor component with the mounting surface thereof directly affixed to the underside of the selected stabilizer comprises disposing one or more fasteners in openings in a topside of the selected stabilizer and affixing the sensor component to the underside of the selected stabilizer.

31. The method of claim 28, wherein mounting the borehole sensor component comprises suspending the borehole sensor component in the receptacle.

32. The method of claim 28, wherein the selected stabilizer comprises at least one blade extending outward therefrom, and wherein mounting the borehole sensor component comprises mounting the borehole sensor component at the at least one blade.

33. The method of claim 28, wherein the plurality of stabilizers comprise at least two stabilizers for at least two different sized boreholes; wherein selecting and disposing one of the plurality of stabilizers comprises interchangeably disposing the selected stabilizer on the outer surface of the drilling body; and wherein mounting the borehole sensor component comprises mounting the borehole sensor component to have a same standoff from a wall of the at least two different sized boreholes.

34. The method of claim 28, wherein mounting the borehole sensor component with the mounting surface thereof directly affixed to the underside of the selected stabilizer comprises:

disposing the mounting surface against the underside; and at least partially exposing a surrounding surface of the borehole sensor component in the receptacle, wherein fluid pressure of the borehole in the receptacle acts against the surrounding surface of the housing and forces the mounting surface against the first underside.

35. The method of claim 28, wherein mounting the borehole sensor component comprises exposing a sensor element in an opening on a topside of the selected stabilizer; and wherein the method further comprising isolating a first fluid pressure of the borehole from a second fluid pressure in the sensor component by sealing the sensor element in the sensor component;

wherein a pressure differential between the first and second fluid pressures forces the sensor element into the sensor component.

36. A borehole drilling tool, comprising:

a drilling body having an outer surface and defining a receptacle exposed in the outer surface;

at least one stabilizer having an underside, the at least one stabilizer disposed on the outer surface of the drilling body and covering the receptacle; and a sensor component for measuring in the borehole, the sensor component disposed in the receptacle and comprising a housing mounted directly to the underside of the at least one stabilizer, the housing comprising a mounting surface disposed against the underside and comprising a surrounding surface at least partially exposed in the receptacle, wherein fluid pressure of the borehole in the receptacle acts against the surrounding surface of the housing and forces the mounting surface against the underside.

37. The tool of claim 36, wherein the drilling body comprises a drill collar for a drillstring; and wherein the at least one stabilizer comprises a cylindrical sleeve fitting around the outer surface of the drilling body.

38. The tool of claim 36, wherein one or more fasteners dispose in openings in a topside of the at least one stabilizer and affix the sensor component to the underside of the at least one stabilizer.

39. The tool of claim 36, wherein the at least one stabilizer comprises at least one blade extending outward therefrom, the sensor component being mounted directly to the underside of the at least one stabilizer at the at least one blade.

40. The tool of claim 36, wherein the at least one stabilizer comprises first and second stabilizers, wherein the sensor component mounted to the first stabilizer has a first standoff from a wall of a first sized borehole; and wherein the second stabilizer has a different size than the first stabilizer, the second stabilizer being interchangeably disposed on the outer surface of the drilling body instead of the first stabilizer and covering the receptacle, the sensor component mounting directly to the underside of the second stabilizer and having a second standoff from a wall of a second sized borehole.

41. The tool of claim 40, wherein the second sized borehole is larger or smaller than the first sized borehole, and wherein the second standoff is approximately equal to the first standoff.

42. The tool of claim 36, wherein the sensor component comprises a sensor element exposed in an opening on a topside of the at least one stabilizer; wherein the sensor element comprises one or more seals sealing the sensor element in the sensor component and isolating a first fluid pressure of the borehole from a second fluid pressure in the sensor component; and wherein a pressure differential between the first and second fluid pressures forces the sensor element into the sensor component.

43. The tool of claim 36, wherein the at least one stabilizer comprises at least two stabilizers having different sizes for use in different sized boreholes, each of the at least two stabilizers interchangeably disposing on the outer surface of the drilling body and covering the receptacle, the housing mounting directly to the underside of either of the at least two stabilizers when disposed on the drilling body; and wherein the sensor component mounted directly to either of the at least two stabilizers has a same standoff distance to walls of the different sized boreholes when disposed relative thereto.

44. A borehole drilling tool, comprising:

a drilling body having an outer surface and defining a receptacle exposed in the outer surface;

at least one stabilizer having an underside, the at least one stabilizer disposed on the outer surface of the drilling body and covering the receptacle; and a sensor component for measuring in the borehole, the sensor component disposed in the receptacle and mounted directly to the underside of the at least one stabilizer, the sensor component comprising a sensor element exposed in an opening on a topside of the first stabilizer, the sensor element comprising one or more seals sealing the sensor element in the sensor component and isolating a first fluid pressure of the borehole from a second fluid pressure in the sensor component, wherein a pressure differential between the first and second fluid pressures forces the sensor element into the sensor component.

45. The tool of claim 44, wherein the drilling body comprises a drill collar for a drillstring; and wherein the at least one stabilizer comprises a cylindrical sleeve fitting around the outer surface of the drilling body.

46. The tool of claim 44, wherein one or more fasteners dispose in openings in a topside of the at least one stabilizer and affix the sensor component to the underside of the at least one stabilizer.

47. The tool of claim 44, wherein the at least one stabilizer comprises at least one blade extending outward therefrom, the sensor component being mounted directly to the underside of the at least one stabilizer at the at least one blade.

48. The tool of claim 44, wherein the at least one stabilizer comprises first and second stabilizers; wherein the sensor component mounted to the first stabilizer has a first standoff from a wall of a first sized borehole; and wherein the second stabilizer has a different size than the first stabilizer, the second stabilizer being interchangeably disposed on the outer surface of the drilling body instead of the first stabilizer and covering the receptacle, the sensor component mounting directly to the underside of the second stabilizer and having a second standoff from a wall of a second sized borehole.

49. The tool of claim 48, wherein the second sized borehole is larger or smaller than the first sized borehole; and wherein the second standoff is approximately equal to the first standoff.

50. The tool of claim 44, wherein the at least one stabilizer comprises at least two stabilizers having different sizes for use in different sized boreholes, each of the at least two stabilizers interchangeably disposing on the outer surface of the drilling body and covering the receptacle, the sensor component mounting directly to the underside of either of the at least two stabilizers when disposed on the drilling body and having a same standoff distance to walls of the different sized boreholes when disposed relative thereto.

* * * * *